United States Patent [19]

Faiks

[11] Patent Number: 5,042,876

[45] **Date of Patent: * Aug. 27, 1991**

[54] CONTROLLER FOR SEATING AND THE LIKE

[75] Inventor: Frederick S. Faiks, Greenville, Mich.

[73] Assignee: Steelcase Inc., Grand Rapids, Mich.

[ * ] Notice: The portion of the term of this patent subsequent to Jun. 25, 2008 has been disclaimed.

[21] Appl. No.: 384,983

[22] Filed: Jul. 25, 1989

Related U.S. Application Data

[63] Continuation-in-part of Ser. No. 317,036, Feb. 28, 1989, abandoned, which is a continuation of Ser. No. 251,057, Sep. 26, 1988, abandoned, which is a continuation of Ser. No. 119,385, Nov. 10, 1987, abandoned.

[51] Int. Cl.[5] ..... A47C 3/02

[52] U.S. Cl. ..... 297/304; 297/300; 297/320; 297/342

[58] Field of Search ..... 297/285, 300, 301, 304, 297/284, 320, 322, 342; 267/131, 175, 177, 179; 248/560, 561, 563, 566, 567, 575, 578, 574, 596, 597

[56] References Cited

U.S. PATENT DOCUMENTS

| | | | |
|---|---|---|---|
| 217,584 | 7/1879 | Chichester . | |
| 240,888 | 5/1881 | Chichester . | |
| 244,733 | 7/1881 | Parry et al. . | |
| 299,846 | 6/1884 | Parry . | |
| 316,127 | 4/1885 | Demand . | |
| 354,183 | 12/1886 | Davis . | |
| 555,029 | 2/1896 | Watkins . | |
| 622,073 | 3/1899 | Quinlan . | |
| 928,051 | 7/1909 | Higgins | 297/286 |
| 981,939 | 1/1911 | Persons . | |
| 1,178,488 | 4/1916 | Bolens . | |
| 1,247,625 | 11/1917 | Bolens . | |
| 1,299,241 | 6/1918 | Bolens . | |
| 1,678,668 | 7/1928 | Collier . | |
| 1,986,105 | 4/1932 | Foote . | |
| 2,087,253 | 7/1937 | Herold . | |
| 2,403,425 | 7/1946 | Bolens . | |
| 2,619,153 | 11/1952 | Van Osselen . | |
| 2,729,273 | 1/1956 | Hamilton et al. . | |
| 2,760,553 | 8/1956 | Lie . | |
| 2,778,409 | 1/1957 | Soderberg . | |
| 2,784,767 | 3/1957 | Soderberg . | |
| 2,818,911 | 1/1958 | Syak . | |
| 2,845,991 | 8/1958 | Soderberg . | |
| 2,877,825 | 3/1959 | Olson . | |
| 2,971,569 | 2/1961 | Parrott et al. . | |

(List continued on next page)

FOREIGN PATENT DOCUMENTS

| | | | |
|---|---|---|---|
| 282928 | 12/1965 | Australia . | |
| 487244 | 10/1952 | Canada . | |
| 1530754 | 6/1969 | Fed. Rep. of Germany . | |
| 2048460 | 5/1971 | Fed. Rep. of Germany . | |
| 432243 | 3/1948 | Italy . | |
| 54-138230 | 9/1979 | Japan . | |
| 340976 | 10/1959 | Switzerland | 297/304 |
| 674251 | 6/1952 | United Kingdom . | |
| 811283 | 4/1959 | United Kingdom . | |
| 840946 | 7/1960 | United Kingdom | 267/131 |
| 1165135 | 9/1969 | United Kingdom | 297/285 |
| 1288773 | 9/1972 | United Kingdom . | |

*Primary Examiner*—Peter R. Brown
*Attorney, Agent, or Firm*—Price, Heneveld, Cooper, DeWitt & Litton

[57] ABSTRACT

A controller is provided for seating, and the like, such as chairs of the type that have a stationary base or support, and a back which tilts about a generally horizontal axis with respect to the support. The controller includes an adjustable tension device, which readily adapts the chair for different users and various applications. The adjustable tension device comprises a spring, having one end operably connected with a support, and the other end operably engaging the back at selected locations spaced apart from the tilt axis, such that rearward tilting of the chair back deflects the spring, and thereby generates a torque or back tension which resists further tilting. A shifter moves the other end of the spring between the selected back locations to vary the lever arm at which the spring acts, and thereby adjusts back tension.

20 Claims, 10 Drawing Sheets

U.S. PATENT DOCUMENTS

| | | | |
|---|---|---|---|
| 3,031,164 | 4/1962 | Schopf | 248/373 |
| 3,135,549 | 6/1964 | Larsson | 297/303 |
| 3,203,661 | 8/1965 | Brendel | 248/399 |
| 3,301,520 | 1/1967 | Barth et al. | 248/399 |
| 3,339,906 | 9/1967 | Persson | 267/1 |
| 3,437,304 | 4/1969 | Decker | 248/399 |
| 3,594,040 | 7/1971 | Monroe | 297/307 |
| 3,650,498 | 3/1972 | Deak | 248/18 |
| 3,659,819 | 5/1972 | Wolters | 284/373 |
| 3,669,399 | 6/1972 | Wager | 248/373 |
| 3,685,780 | 8/1972 | Stannebein | 248/399 |
| 3,693,925 | 9/1972 | Weinstein | 248/378 |
| 3,756,552 | 9/1973 | Wilhelms | 248/399 |
| 3,806,075 | 4/1974 | Sturhan | 248/399 |
| 3,897,036 | 7/1975 | Nystrom | 248/399 |
| 4,013,257 | 3/1977 | Paquette | 248/379 |
| 4,018,415 | 4/1977 | Wolters | 297/304 |
| 4,019,777 | 4/1977 | Hayashi | 297/284 |
| 4,077,596 | 3/1978 | Pinaire et al. | 248/379 |
| 4,103,858 | 8/1978 | Swenson | 248/399 |
| 4,575,150 | 3/1986 | Smith | 297/300 |
| 4,595,236 | 6/1986 | Rizzoli | 297/316 |
| 4,671,569 | 6/1987 | Kazaskadul | 297/284 |
| 4,712,835 | 12/1987 | Volhle | 297/304 |
| 4,714,291 | 12/1987 | Halton | 297/284 |
| 4,744,600 | 5/1988 | Inoue | 297/304 X |
| 4,830,431 | 5/1989 | Inoue | 297/304 X |

FIG. 5
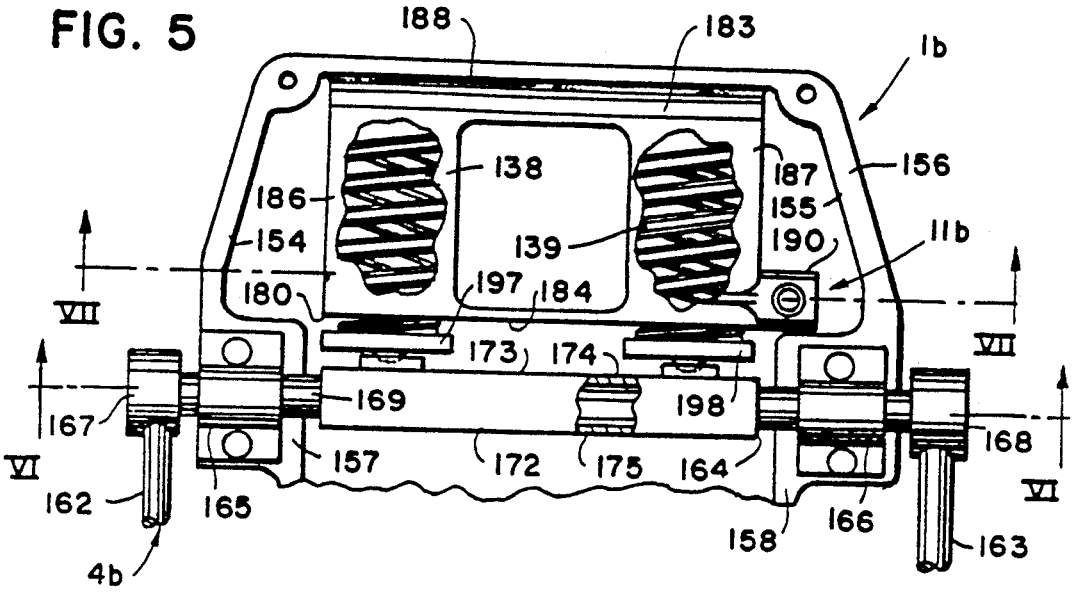
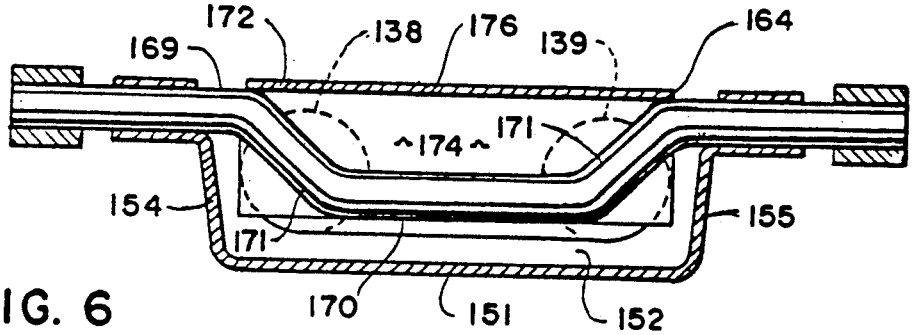
FIG. 6
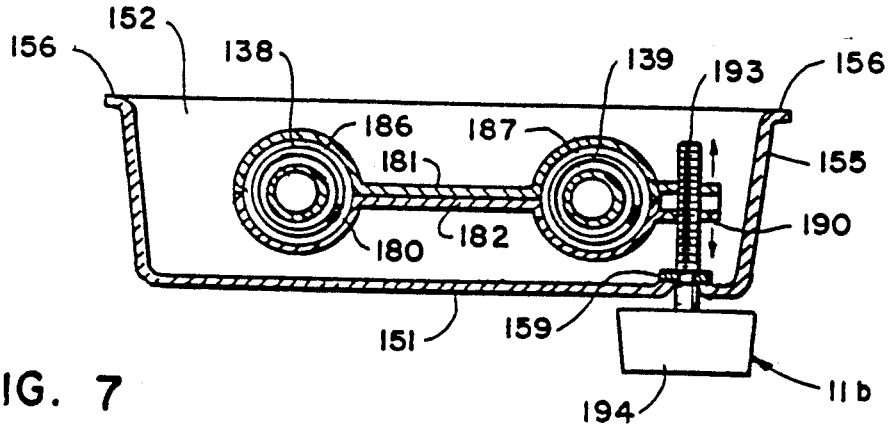
FIG. 7

CONTROLLER FOR SEATING AND THE LIKE

CROSS-REFERENCE TO RELATED APPLICATIONS

The present application is a continuation-in-part of co-pending U.S. patent application Ser. No. 07/317,036 filed Feb. 28, 1989, entitled CONTROLLER FOR SEATING AND THE LIKE, which is a continuation of Ser. No. 07/251,057 dated Sept. 26, 1988, which is a continuation of Ser. No. 07/119,385 dated Nov. 10, 1987.

BACKGROUND OF THE INVENTION

The present invention relates to controllers for seating, and the like.

Articulated seating, such as tilt back chairs, swivel chairs, and other furniture articles of the type having at least two, mutually adjustable portions, are used extensively in office environments. The mutually adjustable portions of the seating are normally interconnected by a control or controller, having springs which bias the seating into a normal, fully upright position. The controller typically includes some type of adjustment device to vary the biasing forces which resist movement of the adjustable portions of the seating from their normal position.

In the specific example of tilt back chairs, the controller may have an adjustment device to regulate the "pretension" on the back, and/or the "tilt rate" of the back, as explained hereinafter. Controller "pretension" refers to the application of an initial force or torque to the back of the chair, which retains the chair back in a normally, fully upright position. The user must apply a positive force to the chair back, which force is sufficient to overcome the controller pretension, before the chair back will tilt rearwardly. Controller "tilt rate" refers to the torque which resists rearward tilting, once the chair back begins to tilt. The controller tilt rate normally varies as a function of the angle of inclination of the back, and depends upon the type of springs used, the location of the tilt axis, and other similar factors.

Because users have widely different physical characteristics, including weight, shape, and strength, the ultimate or most comfortable controller pretension and tilt rate varies from one individual to another. FIG. 1 is a graph which illustrates the torque developed by a chair controller to resist tilting of the back (which in a static state is equal to the torque applied to the back by the user), as a function of the back's tilt angle or rotational displacement from the normally upright position of the chair back. The graph line identified by the letter "L" is an empirically derived function, and represents the controller pretension and the controller tilt rate which is generally preferred by a majority of users that weigh somewhat less than the average body weight of all chair users. The graph line identified by the letter "H" is also an empirically derived function, and represents the controller pretension and the controller tilt rate which is generally preferred by a majority of users that weigh somewhat more than the average body weight of all chair users. Individuals that have a body weight which is more than that associated with graph line "L," but less than that associated with graph line "H," will normally prefer a controller pretension and a controller tilt rate that is somewhere in between graph lines "L" and "H," as identified by the lines Ia, Ib, Ic and Id.

A type of seating known as "task seating" is becoming increasingly popular for use at computer terminals, and other similar work stations. Such work stations typically have more than one work surface or area between which the worker traverses, and may also be shared by several workers. Hence, a task chair cannot only be used at different areas of a work station, but may also be used by several different individuals on a regular basis, and therefore must be particularly adaptable for all types of applications, work surface heights, and tasks. The ability to adjust the controller pretension and controller tilt rate in all types of articulated seating is clearly a preferred feature. However, in task seating, such adjustment capabilities are now being considered nearly essential to the marketability of the chair. It is particularly important that those adjustments for controller pretension and/or tilt rate be capable of being made quickly and easily by the workers themselves. Preferably, the adjustments can be made by the user while actually sitting on the seating, so that the back tension can be quickly tested and easily readjusted, if necessary, to attain maximum comfort. Furthermore, it is important that the tilt function be adjustable throughout a broad range, so as to be able to adapt the chair into a comfortable configuration for a wide variety of different persons and tasks.

SUMMARY OF THE INVENTION

One aspect of the present invention is to provide an efficient and effective controller for seating and the like, such as chairs of the type that have a stationary base or support, and a back which tilts about a generally horizontal axis with respect to the support. The controller has an adjustable tension device, comprising a spring, having one end operably connected with a portion of the support, and the other end operably engaging a portion of the back at selected locations spaced apart from the tilt axis. Rearward tilting of the chair back deflects the spring, and thereby generates a torque or back tension which resists further tilting A shifter moves the other end of the spring between the selected back locations to vary the lever arm at which the spring acts, and thereby adjust back tension.

The principal objects of the present invention are to provide a controller for seating, and the like, which is capable of readily adapting the seating for a wide variety of different users and various applications. An adjustable tension device permits the user to quickly and easily adjust the controller pretension and tilt rate while seated on the chair. The controller provides good body and back support throughout various tilt angles, and can be adapted to comfortably accommodate persons having vastly differing physical characteristics. The controller has a relatively uncomplicated construction, is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

BRIEF DESCRIPTION OF THE DRAWINGS

FIG. 5 is a fragmentary, top plan view of the screw shifter controller.

FIG. 6 is a vertical cross-sectional view of the screw shifter controller, taken along the line VI—VI of FIG. 5.

FIG. 7 is a vertical cross-sectional view of the screw shifter controller, taken along the line VII—VII of FIG. 5.

DETAILED DESCRIPTION OF THE PREFERRED EMBODIMENTS

Figure 8:
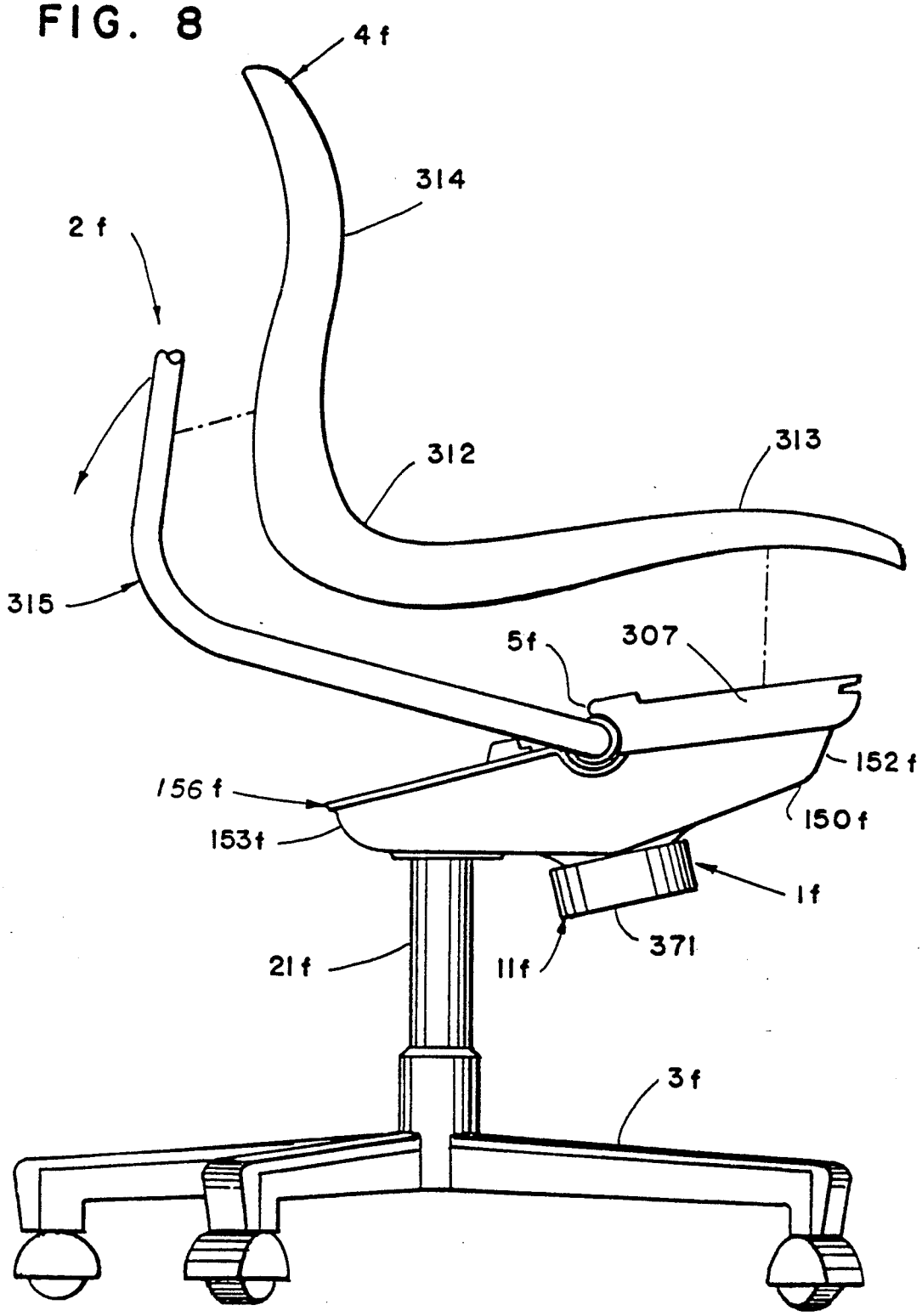
FIG. 8 is an exploded perspective view of a chair having an alternative screw shifter control embodiment of the present invention.

For purposes of description herein, the terms "upper," "lower," "right," "left," "rear," "front," "vertical," "horizontal," and derivatives thereof shall relate to the invention as oriented in FIG. 8, and with respect to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions, and other physical characteristics relating to the embodiments disclosed herein are not to be considered limiting, unless the claims expressly state otherwise.

SCREW SHIFTER CONTROLLER

The reference numeral **1*b* (FIGS. 2–7) designates a screw shifter version of the controller embodying the present invention. In controller 1*b* (FIGS. 5–7) adjustable springs 138 and 139 remain engaged with their mating rack or abutment surface at all times. As a result, friction forces must be overcome to adjust screw shifter controller 1*b*. Also, a screw type of shifter 11*b* is provided in controller 1*b* to vary the lever arm at which springs 138 and 139 act with respect to tilt axis 5*b* of chair back 4*b***.

In the illustrated example, controller **1*b* (FIGS. 2–4) includes a formed, cup-shaped, sheet metal housing 150, which includes a socket 31*b* in which pedestal 21*b* is received to support chair 2*b* on a base (not shown). Control housing 150 includes a base wall 151, a front wall 152, a rear wall 153, and opposite sidewalls 154 and 155. As best illustrated in FIG. 5, the upper edges of control housing 150 are flared outwardly to form a flange 156, which extends along the marginal edge of control housing 150, and includes two enlarged pad areas 157 and 158 adjacent the medial portions of sidewalls 154 and 155. A sleeve 159 (FIG. 7) is mounted in the base wall 151 of control housing 150, and serves to rotatably support screw shifter 11*b*** in the manner described below.

Chair back **4*b* (FIGS. 5–7) is supported on a rod-shaped frame having two arms 162 and 163 extending rearwardly from the pads 157 and 158 of control housing 150. A bell crank 164 is rotatably supported on control pads 157 and 158 by a pair of pillow block type bearings 165 and 166. The forward ends of back frame arms 162 and 163 are fixedly attached to the outer ends of bell crank 164 by a pair of bushings 167 and 168, such that rearward tilting of chair back 4*b* rotates bell crank 164. As best illustrated in FIG. 7, bell crank 164 includes a formed rod 169 with generally U-shaped medial portion, comprising a base segment 170 and oppositely inclined side segments 171. Bell crank 164 also includes a sheath or cover 172 which envelops the medial portion of rod 169, and defines a substantially planar abutment surface 173 which interacts with springs 138 and 139 in the manner described in greater detail below. In the illustrated example, sheath 172 comprises a rigid, formed sheet of sheet metal or the like, having an inverted U-shaped configuration, comprising opposite flanges 174 and 175, and an arcuate web 176. The flanges 174 and 175 of sheath 172 are spaced apart a distance substantially equal to the outside diameter of rod 169, so that it is received closely over the medial portion thereof. Sheath 172 is fixedly attached to the medial portion of rod 169 by suitable means, such as welding or the like, such that abutment surface 173 rotates with rod 169 when chair back 4*b***tilts.

Springs 137 and 138 (FIGS. 5–7) are mounted in control housing 150 by a separate spring housing 180. The illustrated spring housing 180 includes two halves, comprising an upper wall 181, and a lower wall 182. Spring housing 150 has a closed front edge 183, and an open rear edge 184. The sides of spring housing walls 181 and 182 have a semi-cylindrical configuration to define cylindrical apertures or barrels 186 and 187 in which coil springs 137 and 138 are closely received and retained. A semi-cylindrical rib 188 (FIGS. 2–4) extends along the front edge 183 of spring housing 180, and is rotatably received in a mating channel 189 in the front wall 152 of control housing 150.

As best illustrated in FIGS. 5 and 7, spring housing 180 includes an arm 190 which extends laterally from spring barrel 187 toward the sidewall 155 of control housing 150. Arm 190 includes a vertically oriented threaded aperture in which the upper end of shifter 11*b* is received in the manner described in greater detail hereinafter.

Shifter 11*b* (FIG. 7) comprises a threaded rod 193, having a knob 194 attached to a lower end thereof for axial rotation therewith. Threaded rod 193 has an annular groove adjacent its lower end which is rotatably received in bushing 159. The upper end of threaded rod 193 is threadedly engaged in the threaded aperture of arm 190. Rotation of knob 19 shifts the rearward end of spring housing 180 upwardly and downwardly, pivoting spring housing 180 with respect to control housing 150 about rib 188 in the direction of the arrows shown in FIGS. 2 and 4. In the illustrated example, threaded rod 193 is disposed laterally on one side of spring housing 150. However, threaded rod 193 may also be located centrally in spring housing 180, such as between springs 138 and 139 to alleviate torsional forces on spring housing 150.

Coil springs 137 and 138 (FIG. 5) are mounted in the barrels 186 and 187 of spring housing 180, and have their free ends extending outwardly from the rearward edge 184 thereof. A pair of spring guides 197 and 198 are mounted on the free ends of coil springs 137 and 138. Each of the spring guides 197 and 198 includes an inner, cylindrical portion 199 (FIG. 2) shaped to be received within the interior of coil springs 137 and 138, and a circular stop portion 200 which abuttingly engages the free ends of springs 137 and 138. A semispherical knob 201 projects forwardly from the front surface of stop 200. Each coil spring 137 and 138 includes a bearing pad 202, with a semispherical recess 201 in the forward side thereof in which knob 201 is pivotally received, and an abutment surface 204 on the opposite side of recess 203. Bearing surface 204 is slidingly received on and abuts against surface 173 of sheath 172, and thereby transmits resilient force from springs 137 and 138 to bell crank 164.

Figure 1:
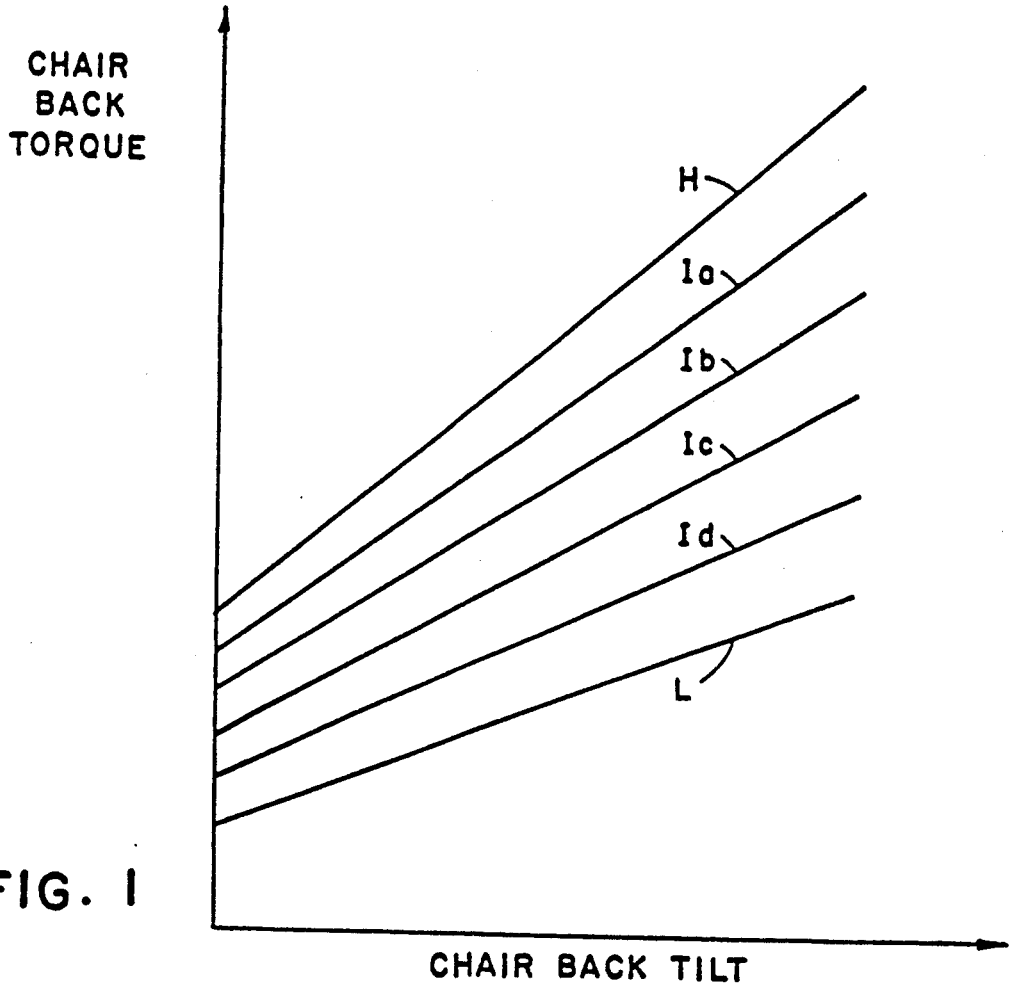
FIG. 1 is a graph illustrating chair back torque as a function of chair back tilt.
Figure 2:
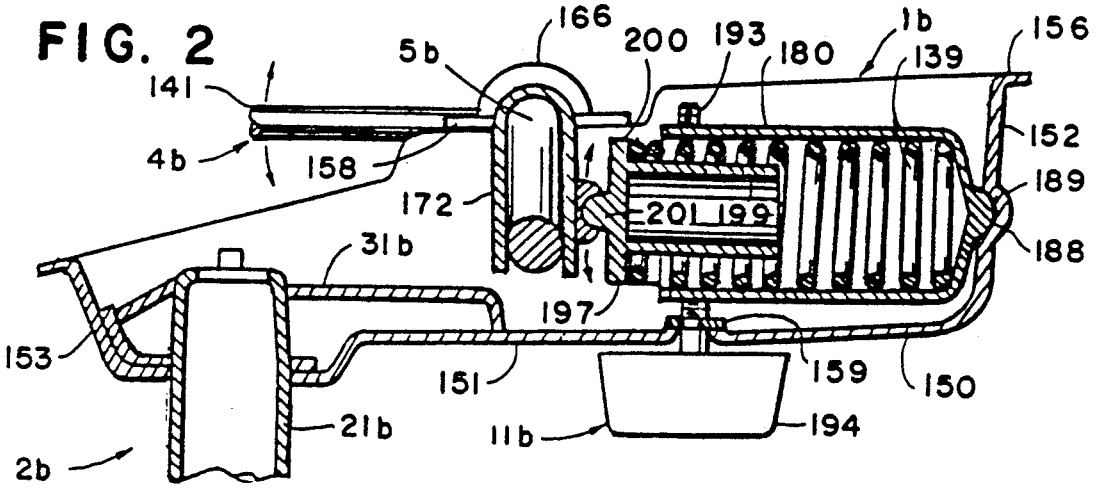
FIG. 2 us a vertical cross-sectional view of a screw shifter embodiment of the present invention, shown with the back tension at a first setting, and the chair back in a fully upright position.
Figure 3:
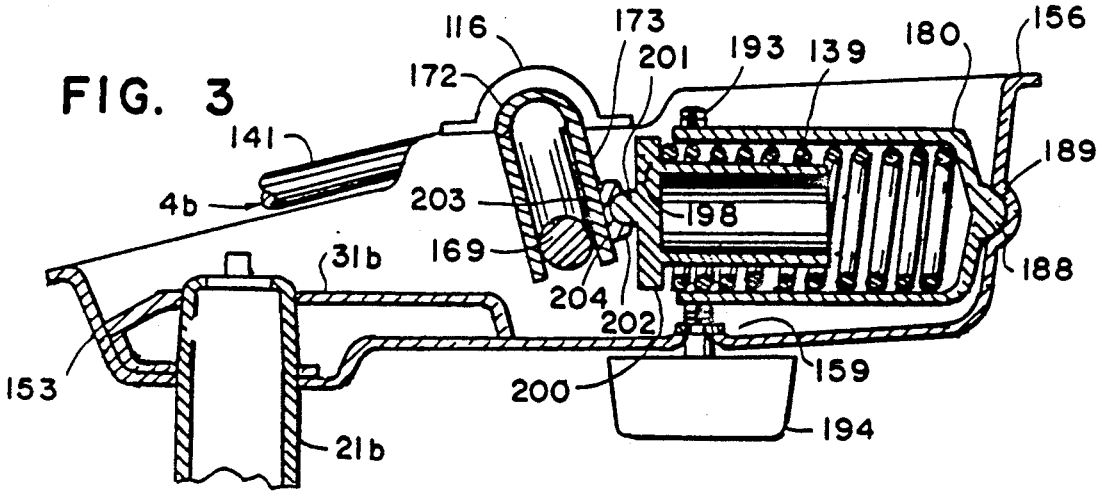
FIG. 3 is a vertical cross-sectional view of the screw shifter controller illustrated in FIG. 2, shown with the back tension at the first setting, and the chair back in a rearwardly tilting position.
Figure 4:
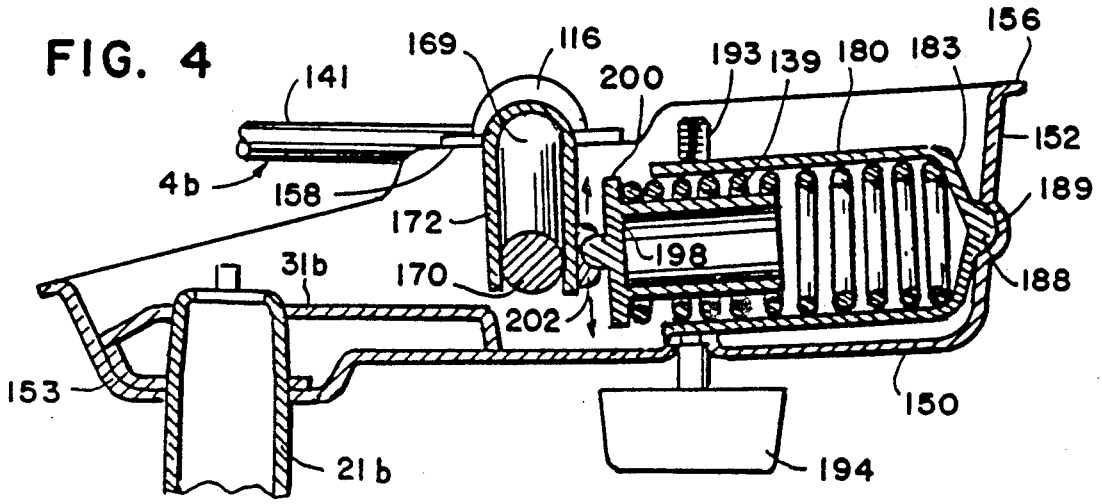
FIG. 4 is a vertical cross-sectional view of the screw shifter controller, shown with the back tension at a second setting, and the chair back in the fully upright position.

In operation, screw shifter controller 1*b* operates in the following fashion. Springs 137 and 138 are normally pretensed in spring housing 180 to apply resilient force to bell crank 164 when chair back 4*b* is in the fully upright position, as illustrated in FIGS. 2 and 4. When chair back 4*b* is tilted rearwardly, as illustrated in FIG. 3, springs 137 and 138 are further compressed to generate additional force which resists further rearward tilting of chair back 4*b*. To adjust both the pretension and tilt rate of chair back 4*b*, the user simply grasps and rotates knob 194 axially, thereby pivoting spring housing 180 in either a clockwise or counterclockwise direction, as oriented in FIGS. 2–4. Rotation of spring housing 180 causes bearing pads 202 to slide along bell crank surface 173 either toward or further away from the tilt axis 5*b* of chair back 4*b*, in the directions illustrated by the arrows in FIGS. 2 and 4. When spring housing 180 is shifted in a manner which moves bearing pads 202 closer to the tilt axis 5*b* of chair back 4*b*, the back tension is reduced, since the lever arm at which springs 137 and 138 act is decreased. When spring housing 180 is rotated in the opposite direction, moving bearing pads 202 away from the tilt axis 5*b* of chair back 4*b*, the back tension is increased, since the lever arm at which springs 137 and 138 act is increased.

ALTERNATIVE SCREW SHIFTER CONTROLLER

The reference numeral 1*f* (FIGS. 8–18) designates an alternative screw shifter version of the controller embodying the present invention. Since alternative screw shifter controller 1*f* is similar to the previously described screw shifter controller 1*b*, similar parts appearing in FIGS. 2–7 and 8–18 are represented by the same, corresponding reference numeral, except for the suffix "f" in the numerals of the latter.

Figure 11:
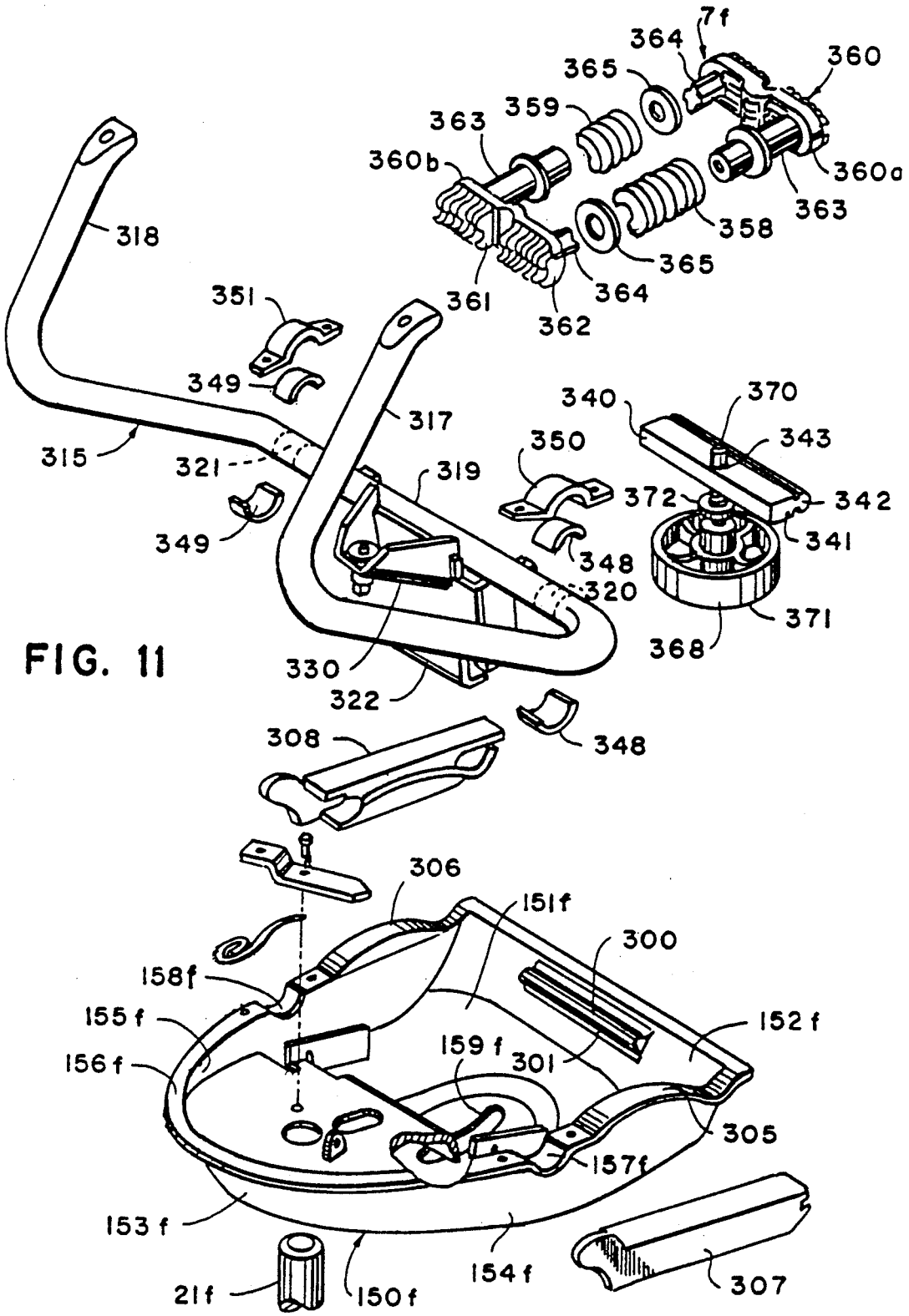
FIG. 11 is another exploded perspective view of the alternative screw shifter controller.
Figure 13:
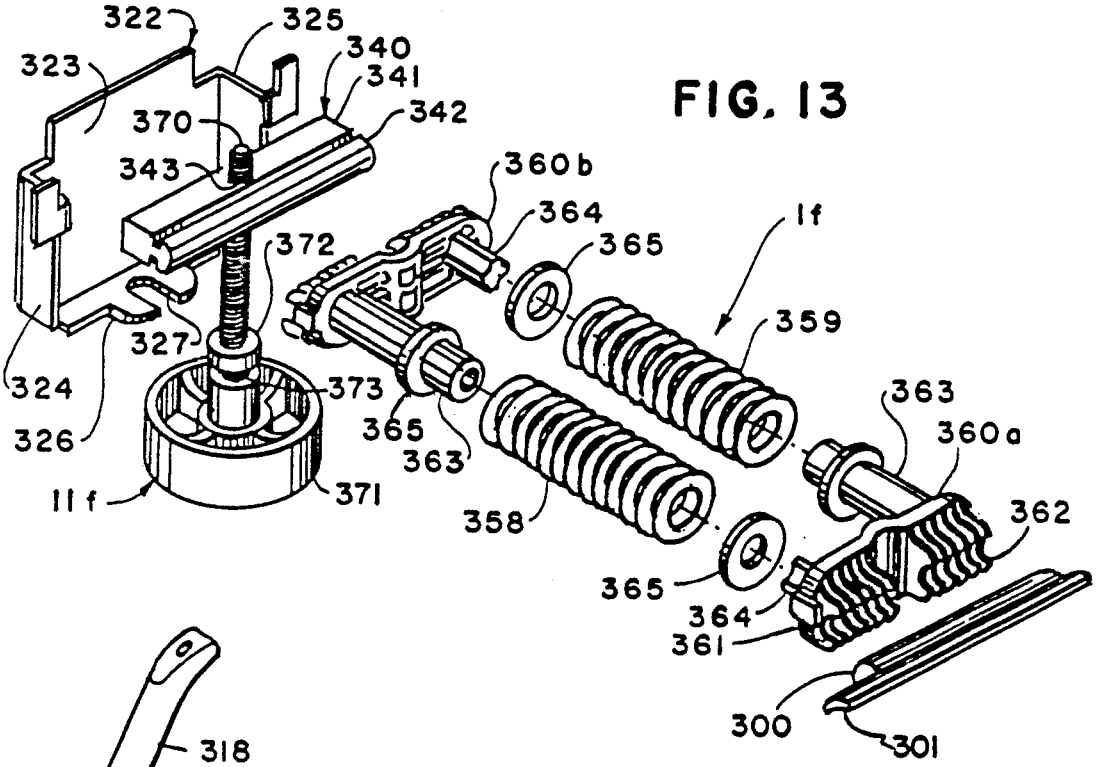
FIG. 13 is another exploded perspective view of the alternative screw shifter controller.
Figure 12:
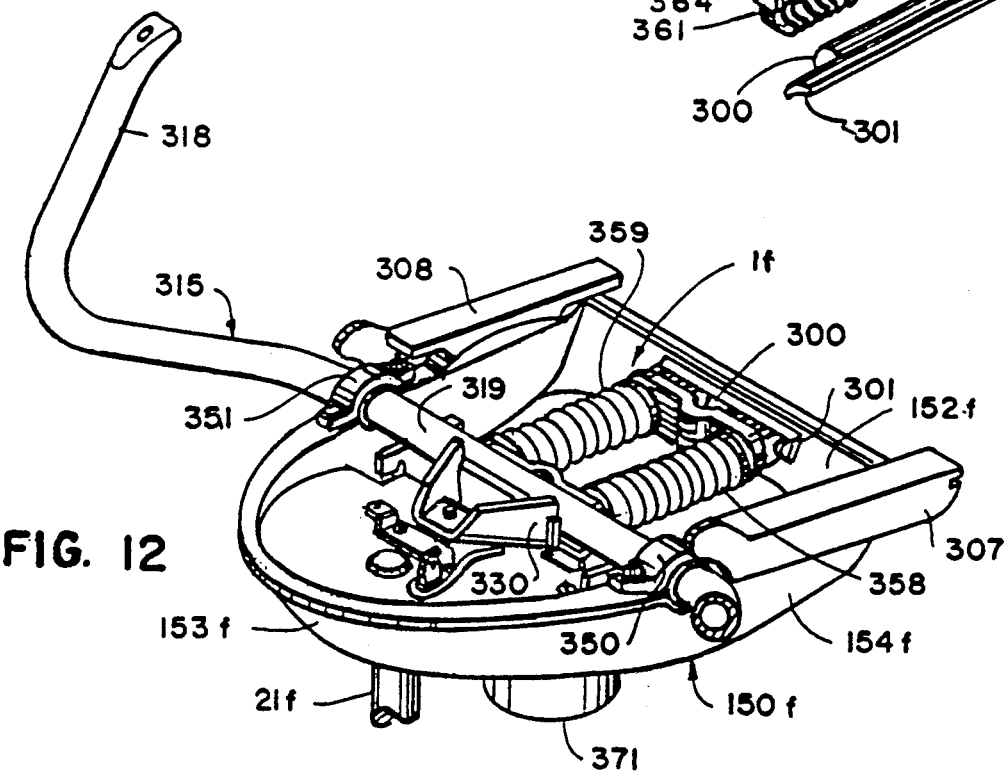
FIG. 12 is another exploded perspective view of the alternative screw shifter controller.
Figure 14:
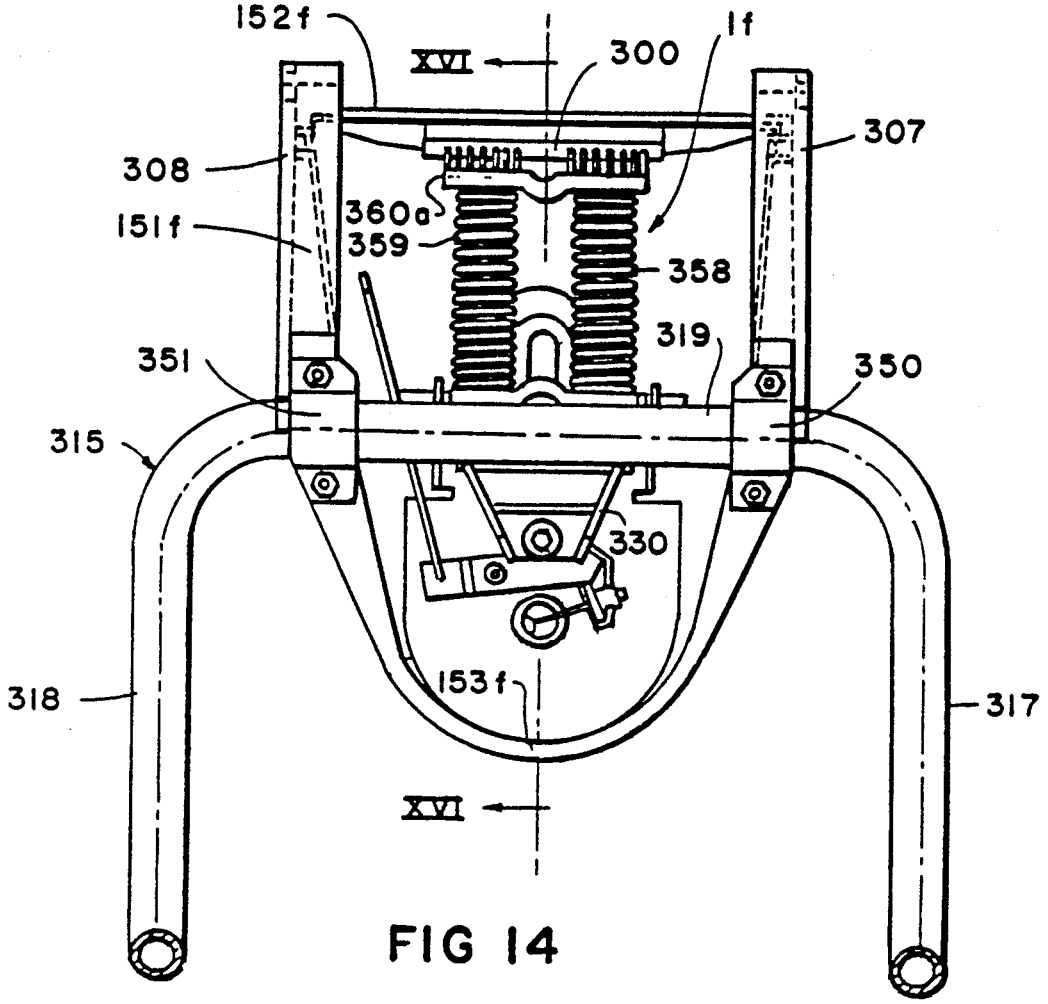
FIG. 14 is a fragmentary, top plan view of the alternative screw shifter controller.
Figure 15:
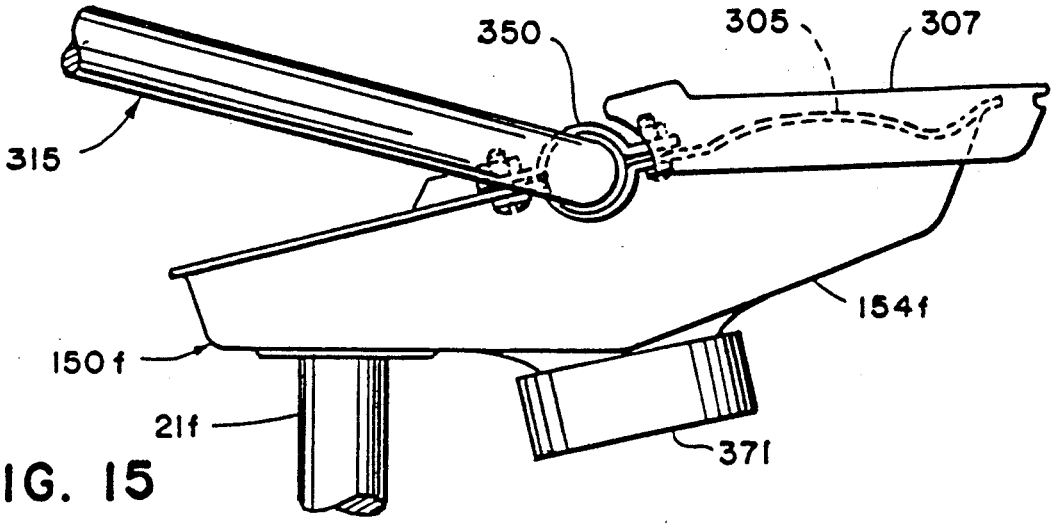
FIG. 15 is a fragmentary side elevational view of the alternative screw shifter controller.

In the illustrated example, controller 1*f* (FIG. 9) includes a formed, cup-shaped sheet metal housing 150*f*, which includes a socket 31*f* in which a pedestal 21*f* (FIG. 8) is received to support chair 2*f* on base 3*f*. Control housing 150*f* (FIG. 9) includes a base wall 151*f*, a front wall 152*f*, an arcuate rear wall 153*f*, and opposite sidewalls 154*f* and 155*f*. As best illustrated in FIG. 11, the upper edges of control housing 150*f* are flared outwardly to form a flange 156*f*, which extends around the marginal edge of control housing 150*f*, and includes two, arcuately shaped bearing pad areas 157*f* and 158*f* adjacent the medial portions of side-walls 154*f* and 155*f*. A slot 159*f* is disposed through the base wall 151*f* of control housing 150*f* adjacent front wall 152*f*, and serves to permit screw shifter 11*f* to pivot during use in the manner described below.

A stationary front bearing 300 (FIG. 11) is fixedly mounted on the interior side of the front wall 152*f* of control housing 150*f*, and serves to support one end of spring assembly 7*f* in the manner described in greater detail below. In the illustrated example, stationary front bearing 300 is generally cylindrically shaped, and includes a mounting plate 301 positioned on the rearward side thereof which attaches bearing 300 to housing front wall 152*f*. A pair of arcuately shaped, upwardly extending bearing surfaces 305 and 306 are formed in the flange 157*f* of control housing 150, adjacent the forward portion thereof. Arcuate bearings 305 and 306 are adapted to slidingly receive and mount thereon mating slides 307 and 308 for supporting the chair seat in the manner described in greater detail hereinafter.

Chair 2*f* (FIG. 8) includes a one-piece, integrally molded, flexible shell 312, having a seat portion 313 attached to and supported by slides 307 and 308, and a back portion 314 attached to and supported on a back support member 315. Shell 312 is sufficiently flexible to permit chair back 314 to pivot rearwardly with respect to seat 313, so as to provide a synchrotilt type of chair control motion.

Figure 9:
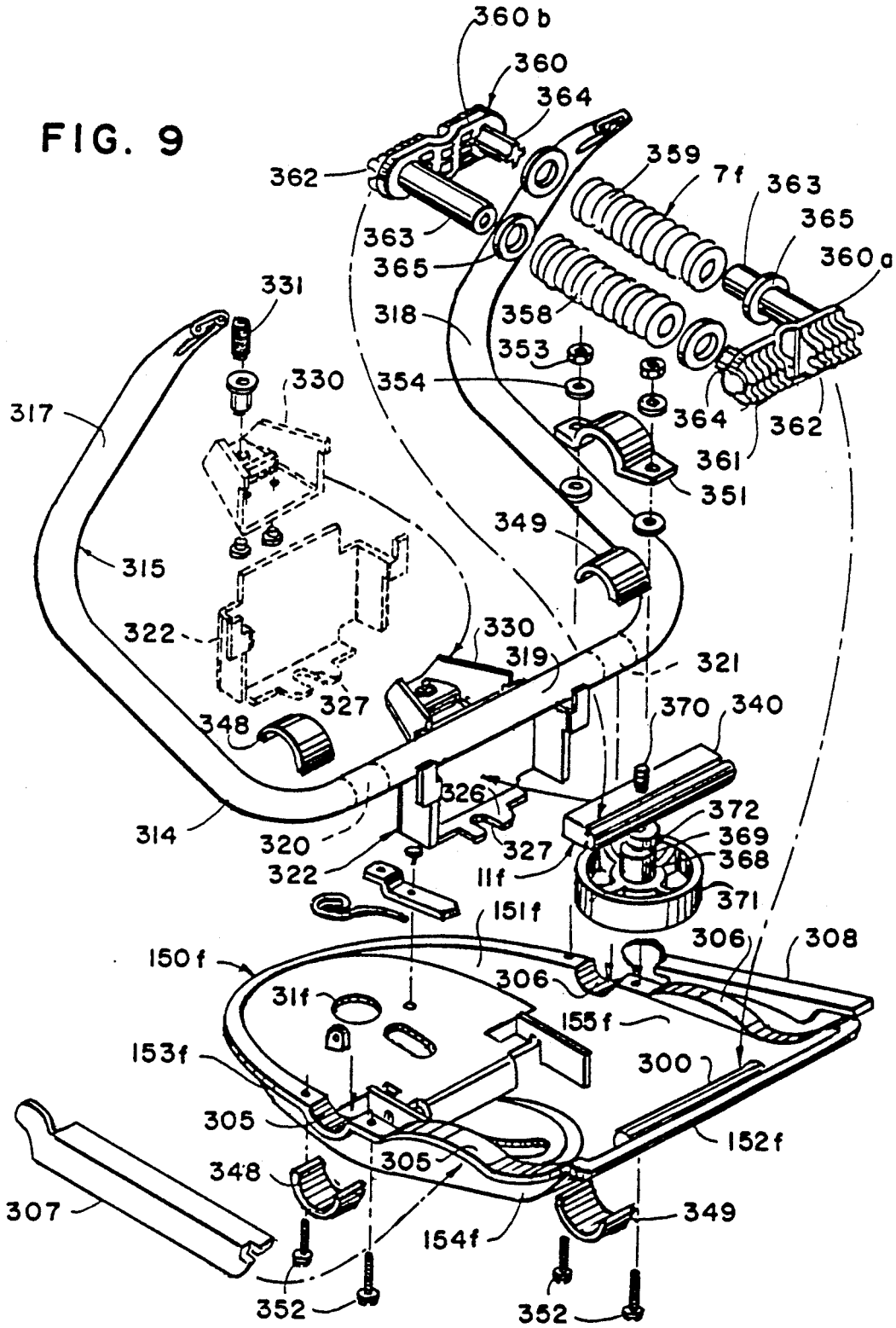
FIG. 9 is an exploded perspective view of the alternative screw shifter controller.

With reference to FIG. 9, back support 315 has a generally U-shaped configuration, and includes a pair of vertically extending arms 317 and 318, which are attached to and support the rear portion 314 of chair shell 312. Back support 315 includes a central portion 319, which extends between arms 317 and 318, and includes a pair of bearing surfaces 320 and 321 disposed on opposite sides thereof. A shifter bracket 322 is fixedly attached to the central portion 319 of back support 315 intermediate bearing surfaces 320 and 321, and rotates therewith. Shifter bracket 322 (FIG. 13) has a substantially U-shaped top plan configuration, comprising a rear wall 323, opposite side-walls 324 and 325, and a forwardly projecting base 326 with an open ended slot 327 therein.

A stop bracket 330 (FIG. 9) is also fixedly attached to back support 315 adjacent shifter bracket 322 at the upper rearward side thereof, and includes an adjustable stop assembly 331 which serves to limit the rearward tilting of chair back 4*f*.

A movable rear bearing 340 is slidably mounted in shifter bracket 322, and includes a generally rectangular shaped rear portion 341 (FIG. 13), and a generally arcuately shaped forward portion 342. The rearward portion 341 of rear bearing 340 is slidingly received between the opposite sides 324 and 325 of shifter bracket 322, and includes a central threaded aperture 343 which cooperates with screw shifter 11*f* as described in greater detail hereinafter. The forward portion 342 of movable rear bearing 340 is shaped similar to the stationary front bearing 300.

Back support 315 (FIG. 9) with attached shifter bracket 322 and stop bracket 330 is rotatably mounted in control housing 150*f* by two pairs of split bearings 348 and 349, and mating bearing brackets 350 and 351. The lower halves of split bearings 348 and 349 are received in the arcuate bearing supports 305 and 306 of control housing 159*f*. The bearing surfaces 320 and 321 on back support 315 are positioned between bearing halves 348 and 349, and bearing brackets 150 and 151 are attached to control housing 150*f* by threaded fasteners 352 and associated nuts 353 and washers 354 the bearing in a manner which permits back support 315 to rotate or pivot with respect to control housing 150*f*.

Figure 10:
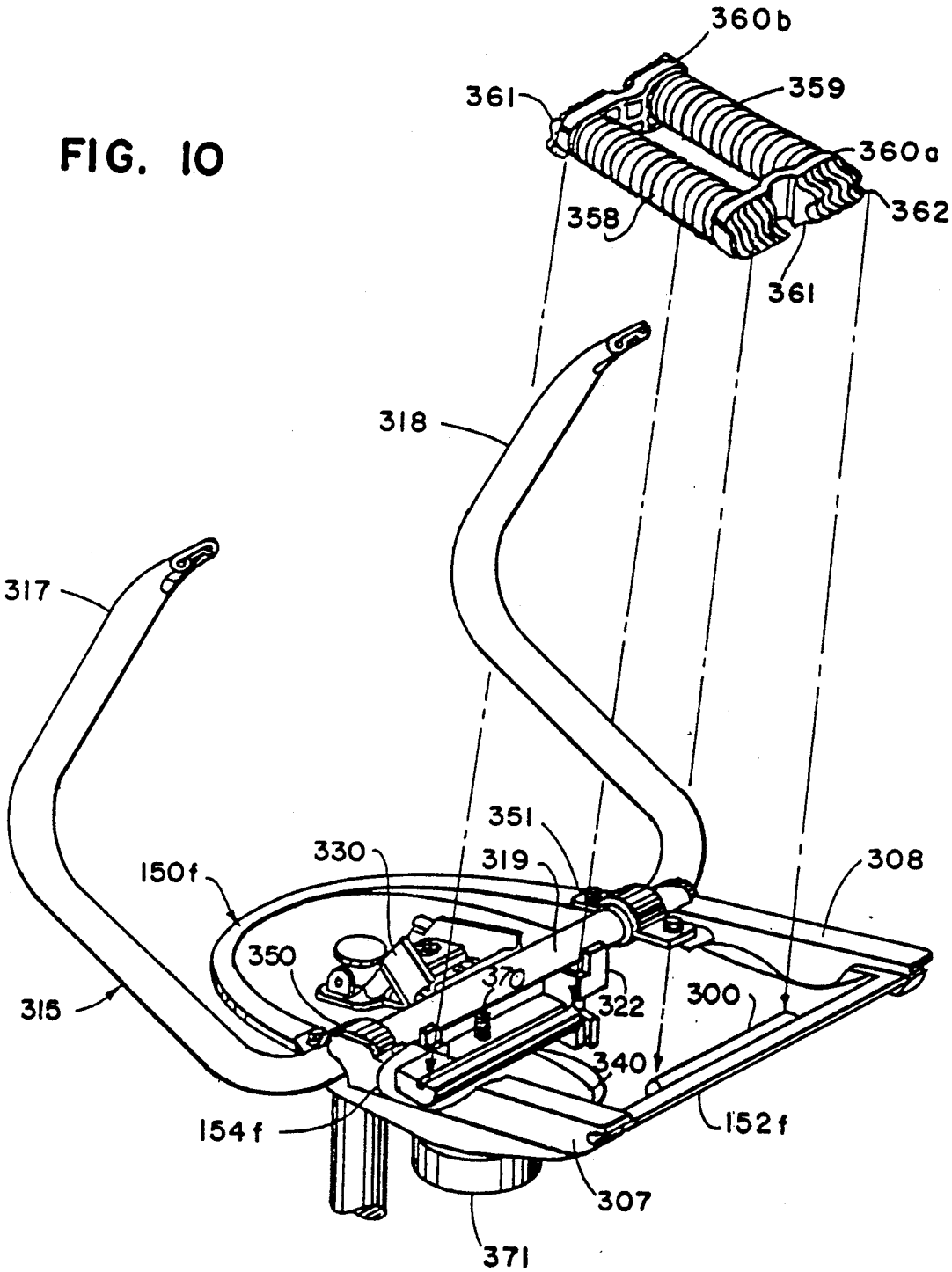
FIG. 10 is another exploded perspective view of the alternative screw shifter controller.

Controller 1*f* includes a pair of coil springs 358 and 359 (FIGS. 9 & 13) which are mounted in a split housing 360 having identical forward and rearward halves 360*a* and 360*b*. Each housing half 360*a* and 360*b* includes a set of ribs 361 extending from one side thereof with arcuate cutouts 362. The opposite side of each of the housing halves 360*a* and 360*b* include a hollow, cylindrically-shaped bushing 363, and a star-shaped stud 364 positioned on opposite sides thereof. Each stud 364 is shaped to be closely received within the interior of a mating bushing 363 on the opposite housing half, so as to provide a telescoping action between the opposite halves 360*a* and 360*b* of spring housing 360. Springs 358 and 359 are received over the bushings 363 on opposite sides of spring housing 360 so as to mount the same thereon, and washers 365 are positioned at the opposite ends of each of the springs 358 and 359. The arcuate cutouts 362 on the forward housing half 360*a* are rotatably received and supported on the stationary front bearing 300, as shown in FIG. 10. The arcuate cutouts 362 on the rear housing half 360*b* are rotatably received and supported on the forward half 342 of movable rear bearing 340, as shown in FIG. 10.

Shifter 11*f* (FIG. 13) comprises a threaded rod 370 having a knob 371 attached to a lower end thereof for axial rotation therewith. Knob 371 has a cylindrically-shaped barrel portion 368 with a flat top 369. The barrel portion 368 of knob 371 is received within the slot 159*f* of control housing 150*f*. Threaded rod 370 has an annularly-shaped washer or disc 372 fixedly mounted thereon adjacent the lower end thereof, which in conjunction with the top 369 of knob 371 forms a shoulder portion 373 of rod 370 that is received within the slot 327 of shifter bracket 322. The upper end of rod 370 is threadedly engaged in the threaded aperture 343 of movable rear bearing 340. Rotation of knob 371 shifts the movable rear bearing 340, and the attached rear half 360*b* of spring housing 360, upwardly and downwardly, thereby pivoting spring housing 360 with respect to control housing 150*f* about fixed forward bearing 300 in the direction of the arrows shown in FIGS. 16 and 17.

Figure 16:
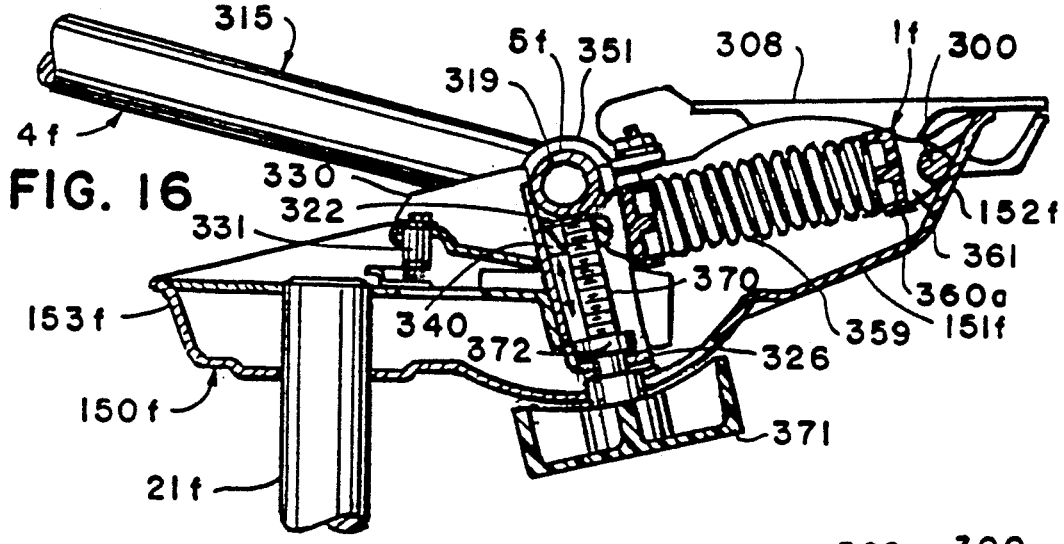
FIG. 16 is a vertical cross-sectional view of the alternative screw shifter controller, taken along the line XVI—XVI of FIG. 14, and shown with the back tension at a first setting, and the chair back in a fully upright position.
Figure 17:
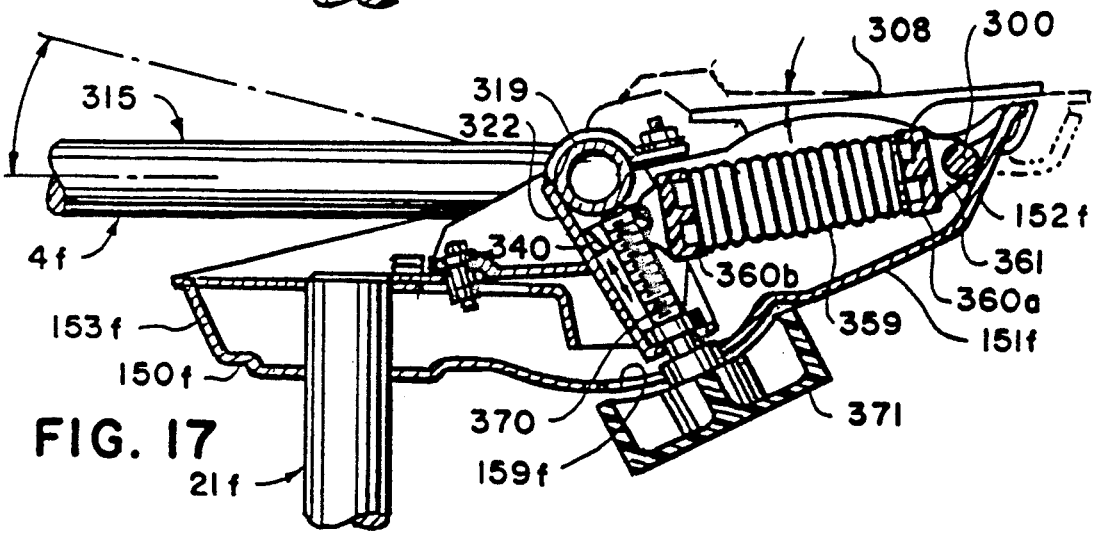
FIG. 17 is a vertical cross-sectional view of the alternative screw shifter controller illustrated in FIG. 16, shown with the back tension at the first setting, and the chair back in a rearwardly tilting position.
Figure 18:
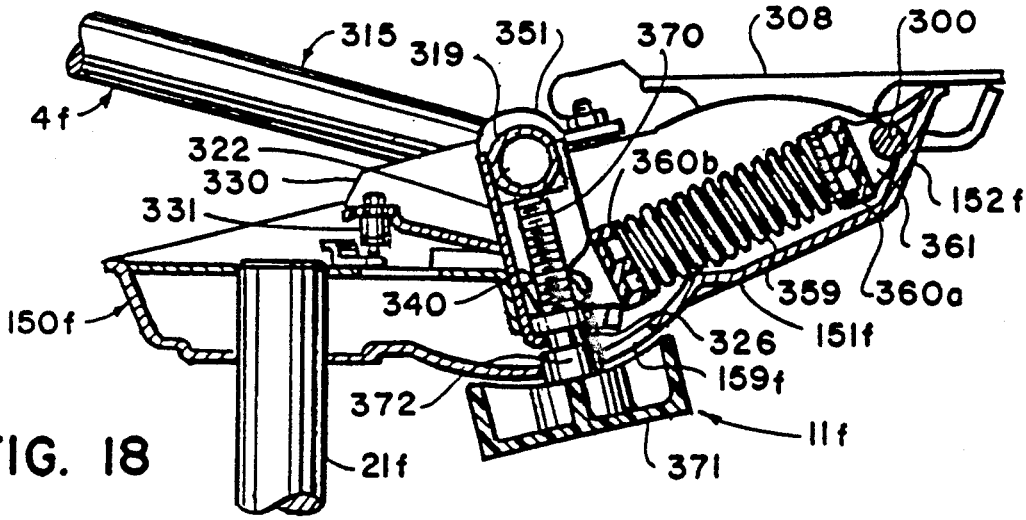
FIG. 18 is a vertical cross-sectional view of the alternative screw shifter controller, shown with the back tension at a second setting, and the chair back in the fully upright position.

In operation, screw shifter controller 1*f* operates in the following fashion. Springs 358 and 359 are normally pretensed in spring housing 360 to apply resilient force to to shifter bracket 322 when chair back 4*f* is in the fully upright position, as illustrated in FIGS. 8, 16 and 18. When chair back 4*f* is tilted rearwardly, as illustrated in FIG. 17, springs 358 and 359 are further compressed to generate additional force which resists further rearward tilting of chair back 4*f*. To adjust both the pretension and tilt rate of chair back 4*f*, the user simply grasps and rotates knob 371 axially thereby pivoting spring housing 360 in either a clockwise or counterclockwise direction, as oriented in FIGS. 16–18. Rotation of spring housing 360 causes movable rear bearing 340 to slide along the rear wall 323 of shifter bracket 322 either toward or further away from the tilt axis 5*f* of chair back 4*f*, in the directions illustrated by the arrows in FIGS. 16 and 17. When spring housing 360 is shifted in the manner which moves movable rear bearing 340 closer to the tilt axis 5*f* of chair back 4*f*, the back tension is reduced, since the lever arm which springs 358 and 359 act is decreased. When spring housing 360 is rotated in the opposite direction, wherein movable rear bearing 340 is shifted away from the tilt axis 5*f* of chair back 4*f*, the back tension is increased, since the lever arm at which springs 358 and 359 act is increased.

As will be appreciated by those having skill in the art, other types of shifter arrangements may be provided to shift the spring housing 180 and associated springs 138 and 139 between the high range and low range positions. Such shifter arrangements may include various combinations of the shifters described and illustrated herein.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. In a chair of the type having a support and a back which tilts about an axis with respect to said support, the improvement of an adjustable, back tension controller, comprising:

a spring having a first end thereof connected with said support, and a second end thereof operably engaging a portion of said back at selected locations thereon which are spaced apart from said tilt axis, whereby rearward tilting of said back deflects said spring, thereby generating a torque which resiliently resists rearward tilting of said back; and a screw rotatably mounted on said support, and operably connected with said spring at a location spaced apart from said first end thereof, whereby axial rotation of said screw shifts said spring second end between the selected locations on said back, whereby said back tension controller is easily and quickly adjusted to adapt said chair for different users and various applications.

2. A chair as set forth in claim 1, wherein:

said spring first end is pivotally mounted on said support.

3. A chair as set forth in claim 2, including:

means for preloading said spring, whereby rearward tilting of said back from a fully upright position is resisted by an initial torque.

4. A chair as set forth in claim 3, wherein:
said spring comprises a coil spring.

5. A chair as set forth in claim 4, wherein:
said screw includes a knob fixedly connected therewith for common rotation, and positioned on said support such that said knob can be manipulated by a user seated in said chair.

6. A chair as set forth in claim 5, wherein:
said back includes a support member with a bracket thereon selectively supporting said spring second end, and defining said back selected locations.

7. A chair as set forth in claim 6, wherein:
said bracket has a movable bearing on which said spring second end is rotatably mounted; and
said screw threadedly engages said movable bearing such that axial rotation of said screw radially shifts said movable bearing with respect to said tilt axis.

8. A chair as set forth in claim 7, wherein:
said spring comprises a pair of coil springs positioned in a side-by-side relationship.

9. A chair as set forth in claim 8, including:
a seat movably supported on said support and being operably connected with said controller, such that when said seat translates, said back tilts to provide a synchrotilt motion.

10. A chair as set forth in claim 9, wherein:
said coil springs are supported in a telescoping spring housing.

11. A chair as set forth in claim 10, wherein:
said telescoping spring housing includes interconnected housing halves which have a substantially identical configuration.

12. A chair as set forth in claim 1, including:
means for preloading said spring, whereby rearward tilting of said back from a fully upright position is resisted by an initial torque.

13. A chair as set forth in claim 1, wherein:
said spring comprises a coil spring.

14. A chair as set forth in claim 1, wherein:
said screw includes a knob fixedly connected therewith for common rotation, and positioned on said support such that said knob can be manipulated by a user seated in said chair.

15. A chair as set forth in claim 1, wherein:
said back includes a support member with a bracket thereon selectively supporting said spring second end, and defining said back selected locations.

16. A chair as set forth in claim 15, wherein:
said bracket has a movable bearing on which said spring second end is rotatably mounted; and
said screw threadedly engages said movable bearing such that axial rotation of said screw radially shifts said movable bearing with respect to said tilt axis.

17. A chair as set forth in claim 1, wherein:
said spring comprises a pair of coil springs positioned in a side-by-side relationship.

18. A chair as set forth in claim 1, including:
a seat movably supported on said support and being operably connected with said controller, such that when said seat translates, said back tilts to provide a synchrotilt motion.

19. A chair as set forth in claim 1, wherein:
said spring is supported in a telescoping spring housing.

20. A chair as set forth in claim 19, wherein:
said telescoping spring housing includes interconnected housing halves which have a substantially identical configuration.

* * * * *